US011086260B2

(12) United States Patent
Akiyama et al.

(10) Patent No.: US 11,086,260 B2
(45) Date of Patent: Aug. 10, 2021

(54) TRANSPORT DEVICE AND IMAGE FORMING APPARATUS

(71) Applicant: FUJIFILM Business Innovation Corp., Tokyo (JP)

(72) Inventors: Shingo Akiyama, Kanagawa (JP); Masataka Konishi, Kanagawa (JP); Shogo Kamiya, Kanagawa (JP); Satoshi Nakamura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/847,639

(22) Filed: Apr. 13, 2020

(65) Prior Publication Data

US 2021/0055677 A1 Feb. 25, 2021

(30) Foreign Application Priority Data

Aug. 23, 2019 (JP) ..... JP2019-152568

(51) Int. Cl.
*G03G 15/00* (2006.01)
*G03G 15/20* (2006.01)
*G03G 15/01* (2006.01)

(52) U.S. Cl.
CPC ..... *G03G 15/6576* (2013.01); *G03G 15/6573* (2013.01); *G03G 15/0189* (2013.01); *G03G 15/2017* (2013.01); *G03G 15/2053* (2013.01); *G03G 15/2064* (2013.01)

(58) Field of Classification Search
CPC ..... G03G 15/6573; G03G 15/6576; G03G 21/1695; G03G 2215/00535; G03G 2215/00662; G03G 2215/00704
See application file for complete search history.

(56) References Cited

U.S. PATENT DOCUMENTS

2010/0172677 A1* 7/2010 Hosokawa ..... G03G 15/2064 399/329
2018/0198936 A1* 7/2018 Kajiyama ..... G03G 15/6576

FOREIGN PATENT DOCUMENTS

JP 2016164644 9/2016

* cited by examiner

*Primary Examiner* — Thomas S Giampaolo, II
(74) *Attorney, Agent, or Firm* — JCIPRNET

(57) ABSTRACT

A transport device includes a first transport member that orbits in a predetermined direction and transports a sheet-like medium; a second transport member that forms a first sandwiching region that is curved and a second sandwiching region that is curved in a direction opposite to the first sandwiching region between the first transport member and the second transport member, and sandwiches and transports the medium in the first sandwiching region and the second sandwiching region; and a changing unit that changes a positional relationship between the first transport member and the second transport member so as to increase a width of the other of the first sandwiching region and the second sandwiching region in a transport direction of the medium without increasing a width of one of the first sandwiching region and the second sandwiching region in the transport direction of the medium.

16 Claims, 10 Drawing Sheets

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2019-152568 filed Aug. 23, 2019.

BACKGROUND

(i) Technical Field

The present invention relates to a transport device and an image forming apparatus.

(ii) Related Art

JP2016-164644A discloses a curve correcting device that forms two curved surfaces at a contact portion between a transport belt and a counter roll by pushing the transport belt against the counter roll by a member that is in contact with an inner peripheral surface of the transport belt.

SUMMARY

According to an exemplary embodiment of the present disclosure, poor curling correction of a medium is suppressed as compared to a case where both a first sandwiching region and a second sandwiching region curved in opposite directions increase.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device including a first transport member that orbits in a predetermined direction and transports a sheet-like medium; a second transport member that forms a first sandwiching region that is curved and a second sandwiching region that is curved in a direction opposite to the first sandwiching region between the first transport member and the second transport member, and sandwiches and transports the medium in the first sandwiching region and the second sandwiching region; and a changing unit that changes a positional relationship between the first transport member and the second transport member so as to increase a width of the other of the first sandwiching region and the second sandwiching region in a transport direction of the medium without increasing a width of one of the first sandwiching region and the second sandwiching region in the transport direction of the medium.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described with reference to the drawings. In addition, an arrow H illustrated in each figure is a vertical direction and indicates an upward-downward direction of an apparatus, and an arrow W is a horizontal direction and indicates a width direction of the apparatus.

First Exemplary Embodiment

Figure 1:
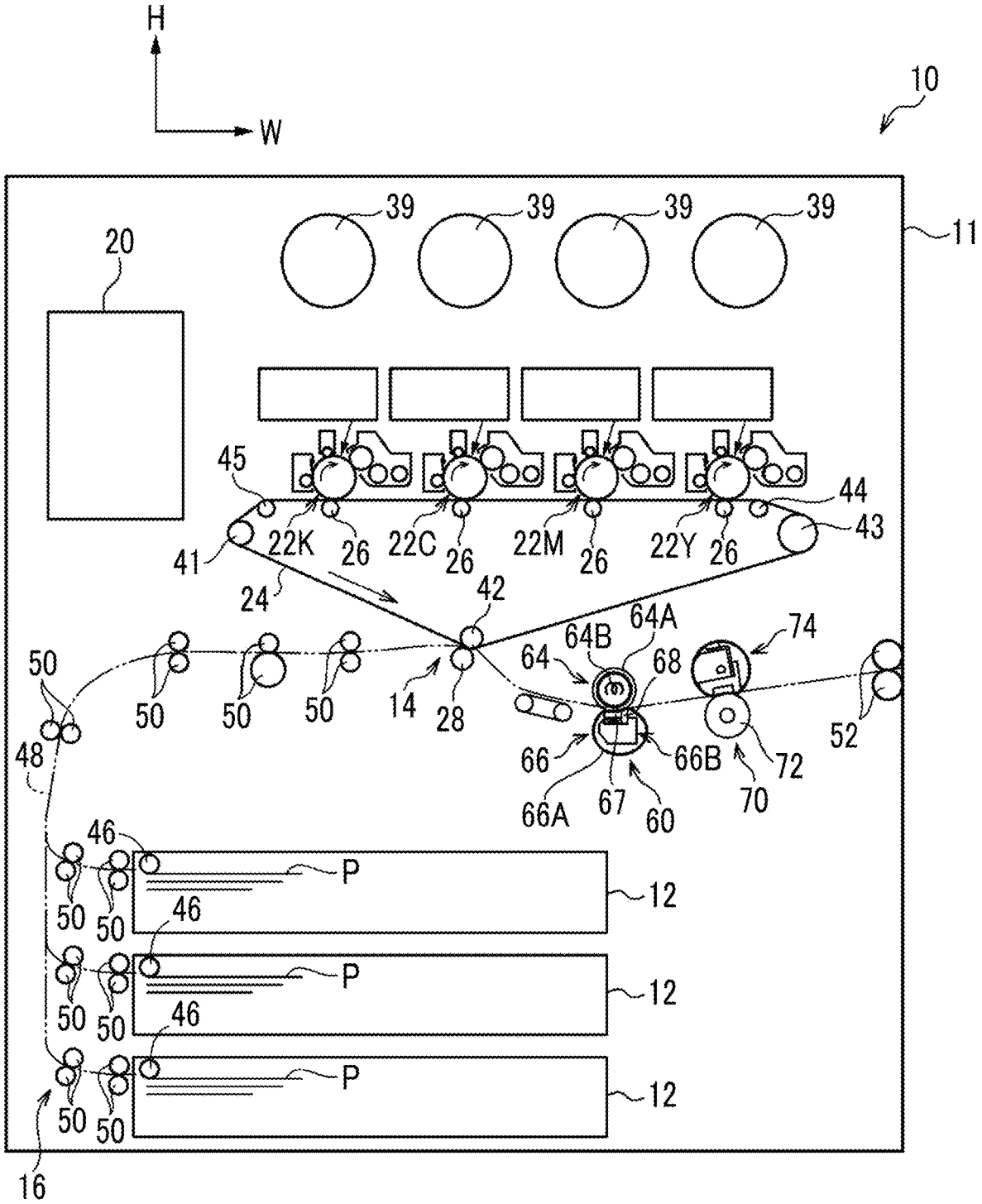
FIG. 1 is a schematic diagram illustrating an image forming apparatus including a transport device according to a first exemplary embodiment.

FIG. 1 is a schematic diagram illustrating an image forming apparatus 10 including a transport device 70 according to a first exemplary embodiment. First, the configuration of the image forming apparatus 10 will be described.

Configuration of Image Forming Apparatus 10

As illustrated in FIG. 1, the image forming apparatus 10 includes an image forming apparatus body 11 (housing) in which respective components are housed. A plurality of storage sections 12 in which a recording medium P as an example of a medium is stored, an image forming section 14 that forms an image on the recording medium P, a transport section 16 that transports the recording medium P from the storage section 12 to the image forming section 14, and a control section 20 that controls the operation of the respective sections of the image forming apparatus 10 are provided inside the image forming apparatus body 11. In addition, the recording medium P is a sheet-like member such as paper.

The image forming section 14 includes image forming units 22Y, 22M, 22C, and 22K (hereinafter referred to as 22Y to 22K) that form toner images of respective colors of yellow (Y), magenta (M), cyan (C), and black (K), an intermediate transfer belt 24 to which the toner images formed by the image forming units 22Y to 22K are transferred, a first transfer roll 26 that transfers the toner images formed by the respective image forming units 22Y to 22K to the intermediate transfer belt 24, and a second transfer roll 28 that transfers the toner images transferred to the intermediate transfer belt 24 by the first transfer roll 26 from the intermediate transfer belt 24 to the recording medium P. In addition, the image forming section 14 is not limited to the above configuration, and may have another configuration as long as an image is formed on the recording medium P.

Figure 2:
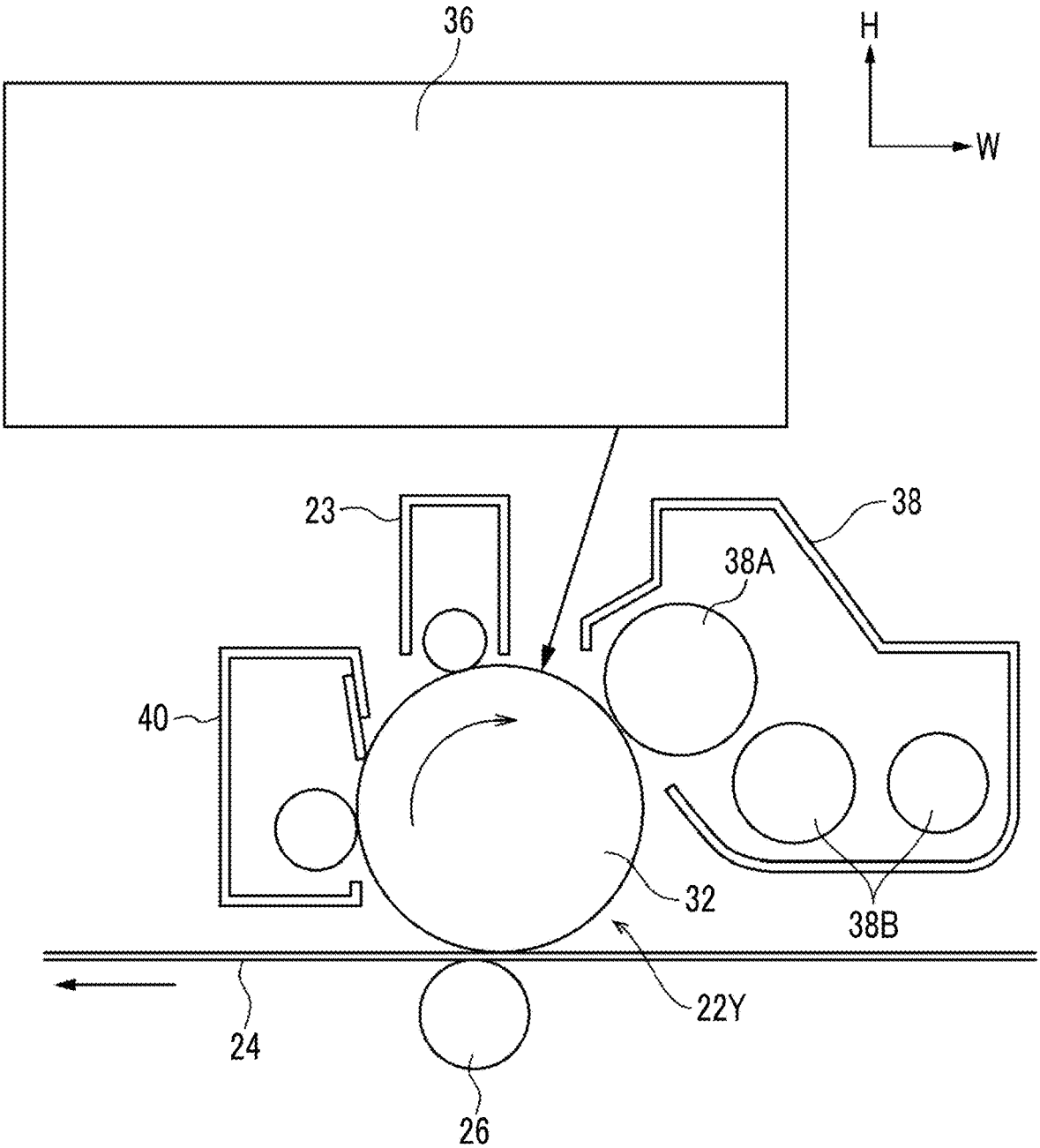
FIG. 2 is a schematic diagram illustrating an image forming unit of the image forming apparatus.

The image forming units 22Y to 22K are arranged in the horizontal direction above the intermediate transfer belt 24. Additionally, as illustrated in FIG. 2, each of the image forming units 22Y to 22K has a photoconductor 32 that rotates in one direction (for example, a clockwise direction in FIG. 2). In addition, since the respective image forming units 22Y to 22K have the same configuration, FIG. 2 illustrates the configuration of the image forming unit 22Y on behalf of the image forming units 22Y to 22K.

A charging device 23 that charges the photoconductor 32, an exposure device 36 that exposes the photoconductor 32 charged by the charging device 23 to form an electrostatic latent image on the photoconductor 32, a developing device 38 that develops the electrostatic latent image formed on the photoconductor 32 by the exposure device 36 to form a toner image, and a removing device 40 that comes into contact with the photoconductor 32 to remove toner remaining on the photoconductor 32 are provided in order from an upstream side in the rotational direction of the photoconductor 32 around each photoconductor 32.

The exposure device 36 forms an electrostatic latent image on the basis of an image signal sent from the control section 20 (refer to FIG. 1). The image signal sent from the control section 20 includes, for example, an image signal acquired from an external device by the control section 20.

The developing device 38 includes a developer supply body 38A that supplies a developer to the photoconductor 32, and a plurality of transport members 38B that transport the developer supplied to the developer supply body 38A while agitating the developer.

As illustrated in FIG. 1, a toner storage portion 39 that stores the toner supplied to the developing device 38 of each of the image forming units 22Y to 22K is provided above each exposure device 36.

The intermediate transfer belt 24 is formed in a ring shape and is disposed below the image forming units 22Y to 22K. Winding rolls 4144, and 45 around which the intermediate transfer belt 24 is wound are provided on an inner peripheral side of the intermediate transfer belt 24. As an example, the intermediate transfer belt 24 circulates (rotates) in one direction (for example, a counterclockwise direction in FIG. 1) while being in contact with the photoconductor 32 by rotationally driving the winding roll 43. In addition, the winding roll 42 is a counter roll facing the second transfer roll 28.

Each first transfer roll 26 faces each photoconductor with the intermediate transfer belt 24 interposed therebetween. A first transfer position where the toner image formed on the photoconductor 32 is transferred to the intermediate transfer belt 24 is between the first transfer roll 26 and the photoconductor 32.

The second transfer roll 28 faces the winding roll 42 with the intermediate transfer belt 24 interposed therebetween. A second transfer position where the toner image transferred to the intermediate transfer belt 24 is transferred to the recording medium P is between the second transfer roll 28 and the winding roll 42.

The transport section 16 has a delivery roll 46 that delivers the recording medium P stored in each storage section 12, a transport path 48 along which the recording medium P delivered to each delivery roll 46 is transported, and a plurality of transport rolls 50 that is disposed along a transport path 48 and transport the recording medium P delivered by each delivery roll 46 to the second transfer position.

A fixing device 60 that fixes the toner image transferred onto the recording medium P by the second transfer roll 28 to the recording medium P is provided on the downstream side of the second transfer position in the transport direction. The fixing device 60 has a heating member 64 and a pressing member 66. In the fixing device 60, the recording medium P is transported while being interposed between the heating member 64 and the pressing member 66, and the toner image is fixed on the recording medium P by heating using the heating member 64 and pressing using the pressing member 66.

Moreover, as illustrated in FIG. 1, the transport device 70 that corrects the curving (hereinafter, referred to as curling) of the recording medium P by sandwiching and transporting the recording medium P on which the toner image has been fixed is provided on the downstream side of the fixing device 60 in the transport direction. In addition, the specific configuration of the transport device 70 will be described below.

A transport roll 52 that transports the recording medium P of which the curling has been corrected toward a discharge unit (not illustrated) is provided on the downstream side of the transport device 70 in the transport direction.

Image Forming Operation

Next, an image forming operation of forming an image on the recording medium P in the image forming apparatus 10 according to the exemplary embodiment will be described.

In the image forming apparatus 10 according to the exemplary embodiment, the recording medium P sent from the storage section 12 by the delivery roll 46 is fed to the second transfer position by the plurality of transport rolls 50.

Meanwhile, in the image forming units 22Y to 22K, the photoconductor 32 charged by the charging device 23 is exposed by the exposure device 36 to form an electrostatic latent image on the photoconductor 32. The electrostatic latent image is developed by the developing device 38 to form a toner image on the photoconductor 32. The toner images of the respective colors formed by the image forming units 22Y to 22K are superimposed on the intermediate transfer belt 24 at the first transfer position to form a superimposed toner image. Then, the toner image formed on the intermediate transfer belt 24 is transferred to the recording medium P at the second transfer position.

The recording medium P to which the toner image has been transferred is transported to the fixing device 60, and the transferred toner image is fixed by the fixing device 60. The recording medium P on which the toner image has been fixed is transported by the transport device 70 to correct the curling. The curling-corrected recording medium P is transported toward the discharge unit (not illustrated) by the transport rolls 52. As described above, a color image is formed on one side of the recording medium P by performing a series of image forming operations.

In addition, the image forming apparatus 10 has a transport path (not illustrated) along which the recording medium P is reversed and sent to the second transfer position before the curling-corrected recording medium P is discharged to the discharge unit (not illustrated). Accordingly, in a case where images are formed on both sides of the recording medium P, the recording medium P on which an image is formed on one side is reversed and sent to the second transfer position, and a color image is formed on the other side.

Configuration of Fixing Device 60

Next, the configuration of the fixing device 60 will be described.

As illustrated in FIG. 1, the fixing device 60 includes the heating member 64 that comes into contact with the surface of the recording medium P on which the toner image is formed, and the pressing member 66 that comes into contact with a back surface (a surface opposite to the toner image) of the recording medium P.

The heating member 64 is constituted by a roll member. The heating member 64 has a heater 64B inside a cylindrical member 64A. A drive source (not illustrated) is connected to the cylindrical member 64A, and the cylindrical member 64A is rotatable by the driving thereof being transmitted from the drive source. Although not illustrated, the cylindrical member 64A includes an elastic layer on an outer peripheral surface side of a core bar.

The pressing member 66 includes an endless fixing belt 66A that moves orbitally following the rotation of the heating member 64, and a pushing portion 66B that is disposed inside the fixing belt 66A and pushes the fixing belt 66A against the heating member 64. The pushing portion 66B supports the fixing belt 66A so as to be movable orbitally.

The pushing portion 66B includes an elastic layer 67 that comes into contact with an inner peripheral surface of the fixing belt 66A, and a protruding portion 68 that comes into contact with the inner peripheral surface of the fixing belt 66A at a position on the downstream side of the elastic layer 67 in the transport direction of the recording medium P. The elastic layer 67 is made of, for example, an elastically deformable member such as rubber. The heating member 64 bites into the elastic layer 67 via the fixing belt 66A, and the elastic layer 67 is curved in a concave shape. Additionally, the protruding portion 68 bites into the cylindrical member 64A via the fixing belt 66A, and the cylindrical member 64A is curved in a concave shape in a direction opposite to the elastic layer 67.

Configuration of Transport Device 70

Next, the configuration of the transport device 70 will be described.

Figure 3:
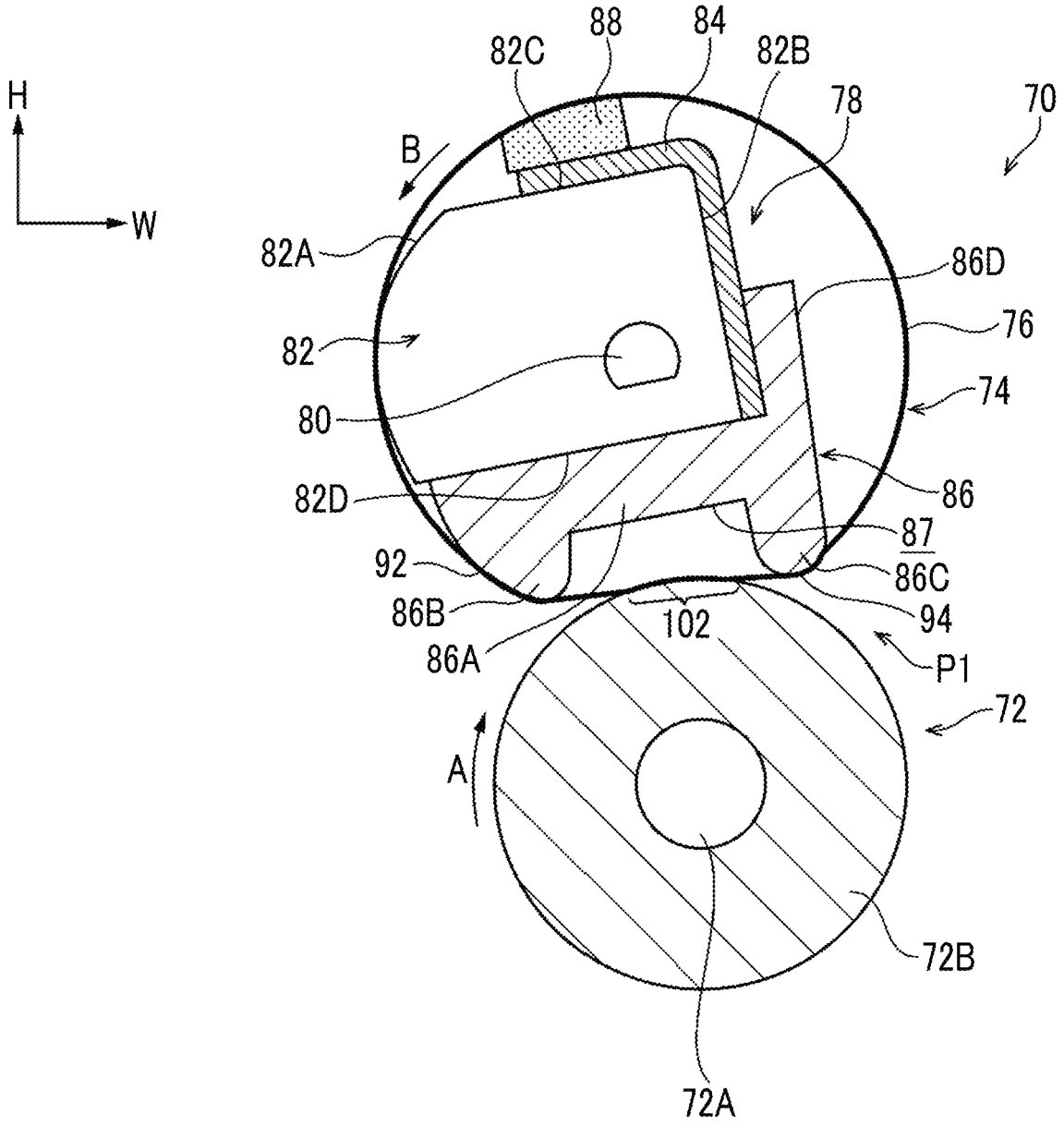
FIG. 3 is a cross-sectional view illustrating a state where the position of a pad in the transport device according to the first exemplary embodiment is changed to a first mode.

FIG. 3 is a cross-sectional view illustrating the configuration of the transport device 70. As illustrated in FIG. 3, the transport device 70 includes a first transport member 72 that rotates in the direction of arrow A, and a second transport member 74 that sandwiches and transports the recording medium P between the first transport member 72 and the second transport member 74. Moreover, the transport device 70 includes a changing device 100 that changes a positional relationship between the first transport member 72 and the second transport member 74 (refer to FIG. 4). Here, the changing device 100 is an example of s changing unit. The transport device 70 has a function as a curling correction device that corrects the curling of the recording medium P.

The second transport member 74 is disposed on a side that comes into contact with the surface of the recording medium P on which the toner image has been formed, and the first transport member 72 is located on the back surface of the recording medium P (that is, the surface opposite to the toner image). In the present embodiment, the recording medium P is transported in the horizontal direction between the fixing device 60 and the transport device 70, the second transport member 74 is disposed above the recording medium P, and the first transport member 72 is disposed below the recording medium P.

The first transport member 72 is constituted by a roll-shaped member. The first transport member 72 includes a circular rotation shaft 72A and an elastic layer 72B that covers the periphery of the rotation shaft 72A. The elastic layer 72B is formed of, for example, heat-resistant rubber or the like. Additionally, in order to suppress the adhesion of the toner to the surface of the elastic layer 72B, a release layer formed of, for example, a resin may be formed on the surface of the elastic layer 72B. A drive source (not illustrated) such as a motor is connected to the rotation shaft 72A, and the first transport member 72 rotates in the direction of arrow A upon receiving the drive transmission from the drive source.

The second transport member 74 includes an endless belt 76 and a support member 78 that is disposed inside the belt 76 and supports the belt 76 such that the belt 76 is movable orbitally. Here, the support member 78 is an example of a rotating member.

The belt 76 is disposed such that an outer peripheral surface thereof comes into contact with the first transport member 72, and moves orbitally in the direction of arrow B following the rotation of the first transport member 72. The belt 76 is formed of, for example, a flexible resin or the like.

The support member 78 includes a shaft portion 80, a block 82 fixed to the shaft portion 80, a holding plate 84 attached to the block 82, and a pad 86 attached to the block 82 and the holding plate 84 on the first transport member 72 side. Moreover, the support member 78 includes a felt 88 attached to the holding plate 84 on the side opposite to the pad 86. The shaft portion 80 is an example of a shaft.

The shaft portion 80 is disposed along the rotation shaft 72A of the first transport member 72. In other words, the shaft portion 80 extends in the direction along the center of the orbital movement of the belt 76. The shaft portion 80 is rotatably supported by housings (not illustrated) disposed on both sides in the axial direction. The shaft portion 80 has a shape in which a part of an outer peripheral surface of a columnar member is cut. The support member 78 is configured to rotate about the shaft portion 80.

The block 82 is fixed to an outer peripheral side of the shaft portion 80 and rotates integrally with the shaft portion 80. The block 82 includes a curved surface 82A formed on one side part. The curved surface 82A is curved more than an inner peripheral surface of the belt 76 (that is, the curvature of the curved surface 82A is larger than the curvature of the belt 76). Moreover, the block 82 includes a side surface 82B formed opposite to the curved surface 82A, and an upper surface 82C and a lower surface 82D that are vertically disposed so as to intersect the side surface 82B. The side surface 82B, the upper surface 82C, and the lower surface 82D are planar. Also, the belt 76 is configured to move orbitally in a state where a part of the inner peripheral surface of the belt 76 is in contact with the curved surface 82A of the block 82.

The holding plate 84 is formed in an L shape in a side view illustrated in FIG. 3, and is in contact with the side surface 82B and the upper surface 82C of the block 82. The holding plate 84 is attached to the side surface 82B and the upper surface 82C of the block 82 by bonding or the like.

The pad 86 includes a body portion 86A, and a pair of support portions 86B and 86C protruding from the body portion 86A toward the first transport member 72. Moreover, the pad 86 includes an extending portion 86D extending from the body portion 86A to the holding plate 84 side. The body portion 86A is in contact with the lower surface 82D of the block 82 and an end surface of the holding plate 84, and the extending portion 86D is in contact with the side surface of the holding plate 84. In this state, the pad 86 is attached to the block 82 and the holding plate 84 by bonding or the like.

The pair of support portions 86B and 86C are arranged at a distance in the transport direction of the recording medium P. The belt 76 is stretched between the pair of support portions 86B and 86C, and the pair of support portions 86B and 86C are in contact with the inner peripheral surface of the belt 76. A recessed portion 87 that is recessed in a direction to recede with respect to the belt 76 is formed between the pair of support portions 86B and 86C, and a space is formed between the recessed portion 87 and the belt 76. One support portion 86B is disposed on the upstream side of the recording medium P in the transport direction, and the other support portion 86C is disposed on the downstream side of the recording medium P in the transport direction.

A curved surface 92 is formed on the distal end side of the support portion 86B, and a part of the inner peripheral surface of the belt 76 is in contact with the curved surface 92. A curved surface 94 is formed on the distal end side of the support portion 86C, and a part of the inner peripheral surface of the belt 76 is in contact with the curved surface 94. In the exemplary embodiment, the curved surface 94 of the support portion 86C has a semicircular shape in a side view illustrated in FIG. 3, and the curvature of a portion of the curved surface 94 which the inner peripheral surface of the belt 76 comes into contacts with is larger than the curvature of the portion of the curved surface 92 at the portion of the support portion 86B with which the inner peripheral surface of the belt 76 comes into contact with.

The felt 88 is attached to the holding plate 84 on the upper surface 82C side of the block 82 by bonding or the like. The felt 88 is in contact with the inner peripheral surface of the belt 76. The felt 88 may be impregnated with a lubricant such as oil, for example, and the coefficient of friction between the pad 86 and the belt 76 is reduced by the oil by applying the oil to the inner peripheral surface of the belt 76. The belt 76 moves orbitally in a state where the inner peripheral surface of the belt 76 is in contact with the felt 88, thereby removing wear powder and the like adhered to the belt 76 (that is, the inner peripheral surface of the belt 76 is cleaned).

Figure 5:
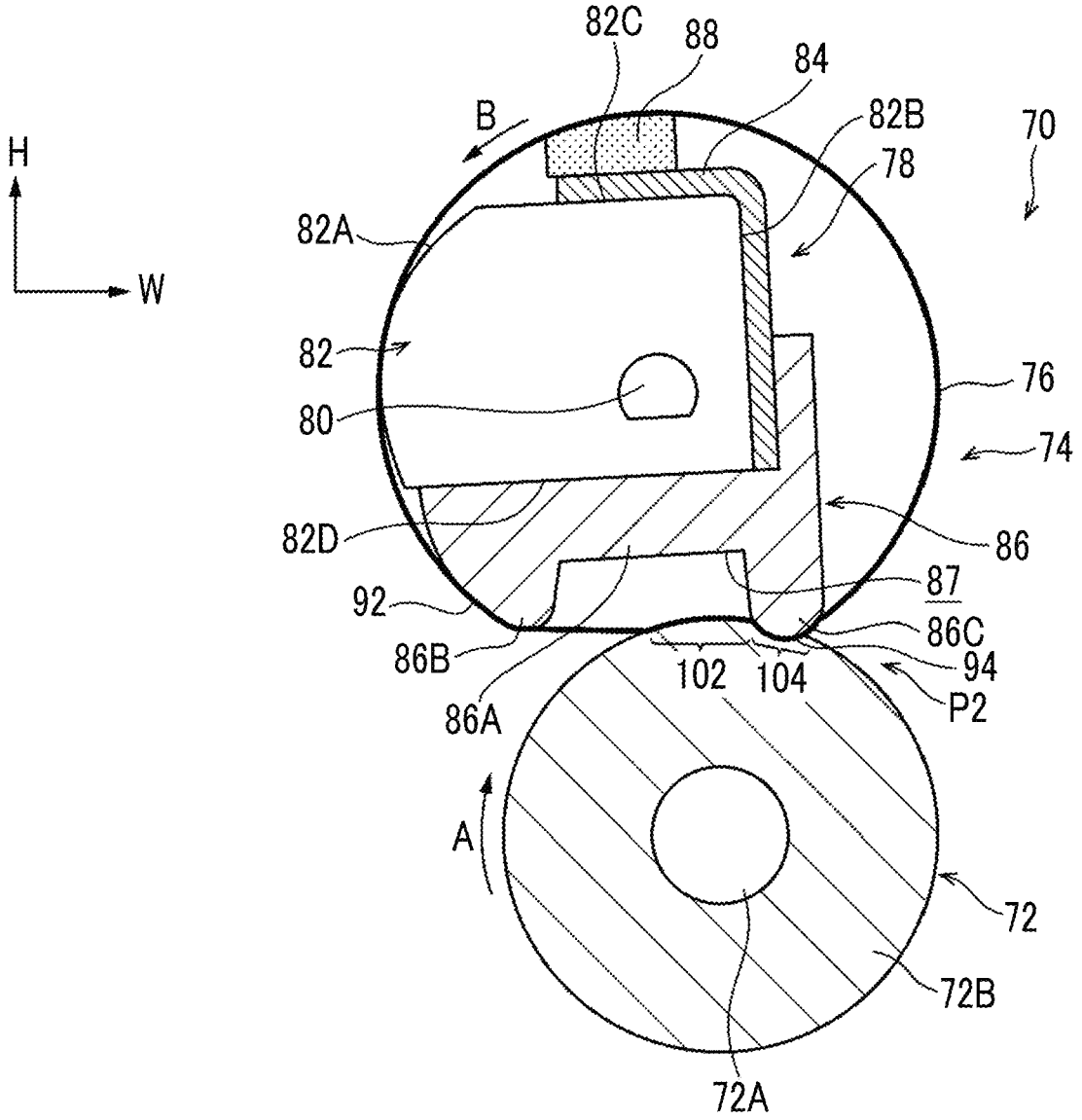
FIG. 5 is a cross-sectional view illustrating a state where the position of the pad in the transport device according to the first exemplary embodiment is changed to a second mode.

In the transport device 70, as illustrated in FIG. 3, the first transport member 72 bites into the belt 76 of the second transport member 74 in the first mode to be described below, and a curved first sandwiching region 102 is formed between the belt 76 and the first transport member 72. Additionally, in the transport device 70, as illustrated in FIG. 5, in the second mode to be described below, the curved first sandwiching region 102 and a second sandwiching region 104 curved in the direction opposite to the first sandwiching region 102 are formed between the belt 76 of the second transport member 74 and the first transport member 72. In the transport device 70, the first sandwiching region 102 (refer to FIG. 3) formed between the belt 76 of the second transport member 74 and the first transport member 72, or the recording medium P is sandwiched and transported the first sandwiching region 102 and the second sandwiching region 104 (refer to FIG. 5).

Configuration of Changing Device 100

Figure 4:
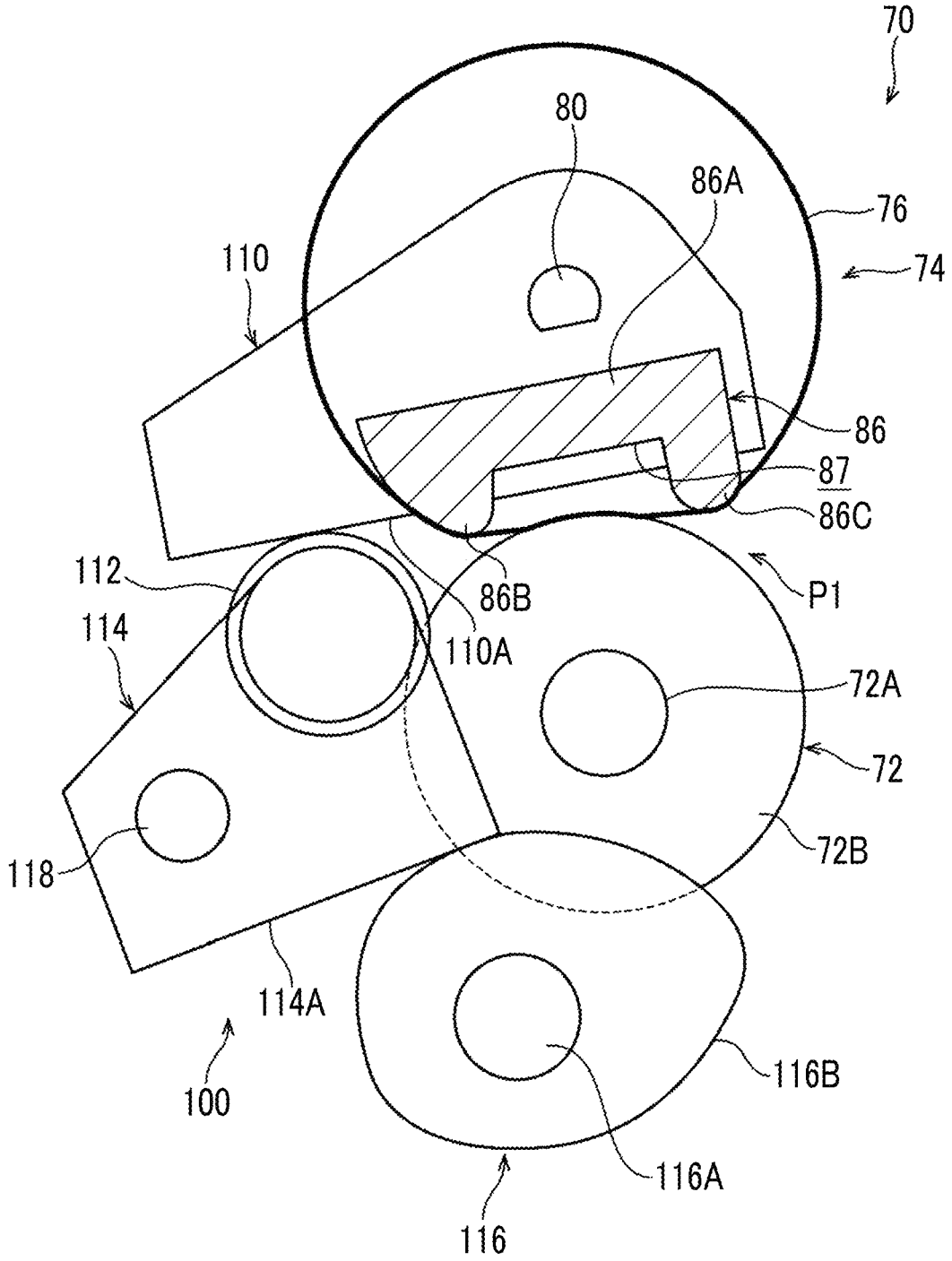
FIG. 4 is a configuration diagram illustrating a state of the cam in the first mode of the transport device according to the first exemplary embodiment.

FIG. 4 is a side view illustrating the changing device 100 disposed at one end of the transport device 70 in the axial direction.

As illustrated in FIG. 4, the transport device 70 includes the changing device 100 that changes the width of the recording medium P in the transport direction in the first sandwiching region 102 and the second sandwiching region 104 by changing a positional relationship between the first transport member 72 and the second transport member 74.

The changing device 100 includes a first lever 110 fixed to the shaft portion 80 of the support member 78, a second lever 114 that comes into contact with the first lever 110 via a rotating body 112, and a cam 116 that comes into contact with the second lever 114.

The first lever 110 includes a planar lower surface 110A disposed along the body portion 86A of the pad 86. The lower surface 110A of the first lever 110 is provided at a position facing the first transport member 72, and extends toward the upstream side in the transport direction of the recording medium P. The first lever 110 is rotatable (that is, rockable) about the shaft portion 80. The changing device 100 is adapted such that, as the first lever 110 rotates about the shaft portion 80, the pad 86 fixed to the shaft portion 80 rotates and the width of the recording medium P in the transport direction in the first sandwiching region 102 and the second sandwiching region 104 is changed.

The second lever 114 includes the rotating body 112 that rotates while coming into contact with the lower surface 110A of the first lever 110. The rotating body 112 is disposed along the rotation shaft 72A of the first transport member 72. The rotating body 112 comes into contact with the lower surface 110A of the first lever 110 on the upstream side of the first transport member 72 in the transport direction of the recording medium P. The second lever 114 is provided with the rotation shaft 118 on the upstream side of the rotating body 112 in the transport direction of the recording medium P (that is, on the side opposite to the first transport member 72). The second lever 114 is rotatable about the rotation shaft 118. The second lever 114 includes the planar lower surface 114A disposed opposite to the second transport member 74.

The cam 116 is rotatably supported about a camshaft 116A. A drive source such as a motor (not illustrated) is connected to the camshaft 116A, and the cam 116 rotates upon receiving the drive transmission from the drive source. In the side view illustrated in FIG. 4, the cam 116 is disposed below a position where the first transport member 72 and the second lever 114 overlap. The outer peripheral surface 116B of the cam 116 is in contact with the lower surface 114A of the second lever 114. In the side view illustrated in FIG. 4, the camshaft 116A is disposed on the downstream side of the rotation shaft 118 of the second lever 114 in the transport direction of the recording medium P (that is, on the first transport member 72 side). A return spring is provided between the cam 116 and the second lever 114 to bring the outer peripheral surface 116B of the cam 116 into contact with the lower surface 114A of the second lever 114.

In the changing device 100, the radius of the portion of the outer peripheral surface 116B that hits the second lever 114 changes due to the rotation of the cam 116, and the second lever 114 that comes into contact with the outer peripheral surface 116B rocks in an upward-downward direction about the rotation shaft 118. As the rotating body 112 opposite to the rotation shaft 118 moves in the upward-downward direction with the rocking of the second lever 114 in the upward-downward direction, the first lever 110 that comes into contact with the rotating body 112 rocks in the upward-downward direction about the shaft portion 80. As the first lever 110 rocks in the upward-downward direction, the pad 86 fixed to the shaft portion 80 via the block 82 rotates about the shaft portion 80.

FIGS. 3 and 4 illustrate a state where the positional relationship between the second transport member 74 and the first transport member 72 is changed to the first position P1 by the rotation of the cam 116 of the changing device 100 (in the exemplary embodiment, this state is referred to as the first mode). In the first mode, a region where the radius of the outer peripheral surface 116B of the cam 116 is a middle length is in contact with the second lever 114 (refer to FIG. 4). As illustrated in FIG. 3, in a case where the second transport member 74 and the first transport member 72 are at the first position P1, only the curved first sandwiching region 102 is formed between the belt 76 of the second transport member 74 and the first transport member 72.

The first sandwiching region 102 is formed in a region where the belt 76 stretched over the pair of support portions 86B and 86C comes into contact with the elastic layer 72B of the first transport member 72. In the exemplary embodiment, the inside of the belt 76 between the pair of support portions 86B and 86C is a space, and an outer surface of the belt 76 is in contact with the elastic layer 72B of the first transport member 72 by tension. That is, the first sandwiching region 102 is formed between the pair of support portions 86B and 86C by the belt 76 being stretched over the pair of support portions 86B and 86C. Here, the recessed portion 87 between the pair of support portions 86B and 86C of the pad 86 is an example of a first curve forming portion that forms the first sandwiching region 102.

The first sandwiching region 102 has an arc (that is, a curved surface) in the same direction as a curved surface of the elastic layer 72B of the first transport member 72, and corrects the curling of the recording medium P in the direction opposite to the curved surface of the first transport member 72. For example, in the first sandwiching region 102, the curling in the direction opposite to the curved surface of the first transport member 72 in a case where the recording medium P is thick paper is corrected.

Figure 6:
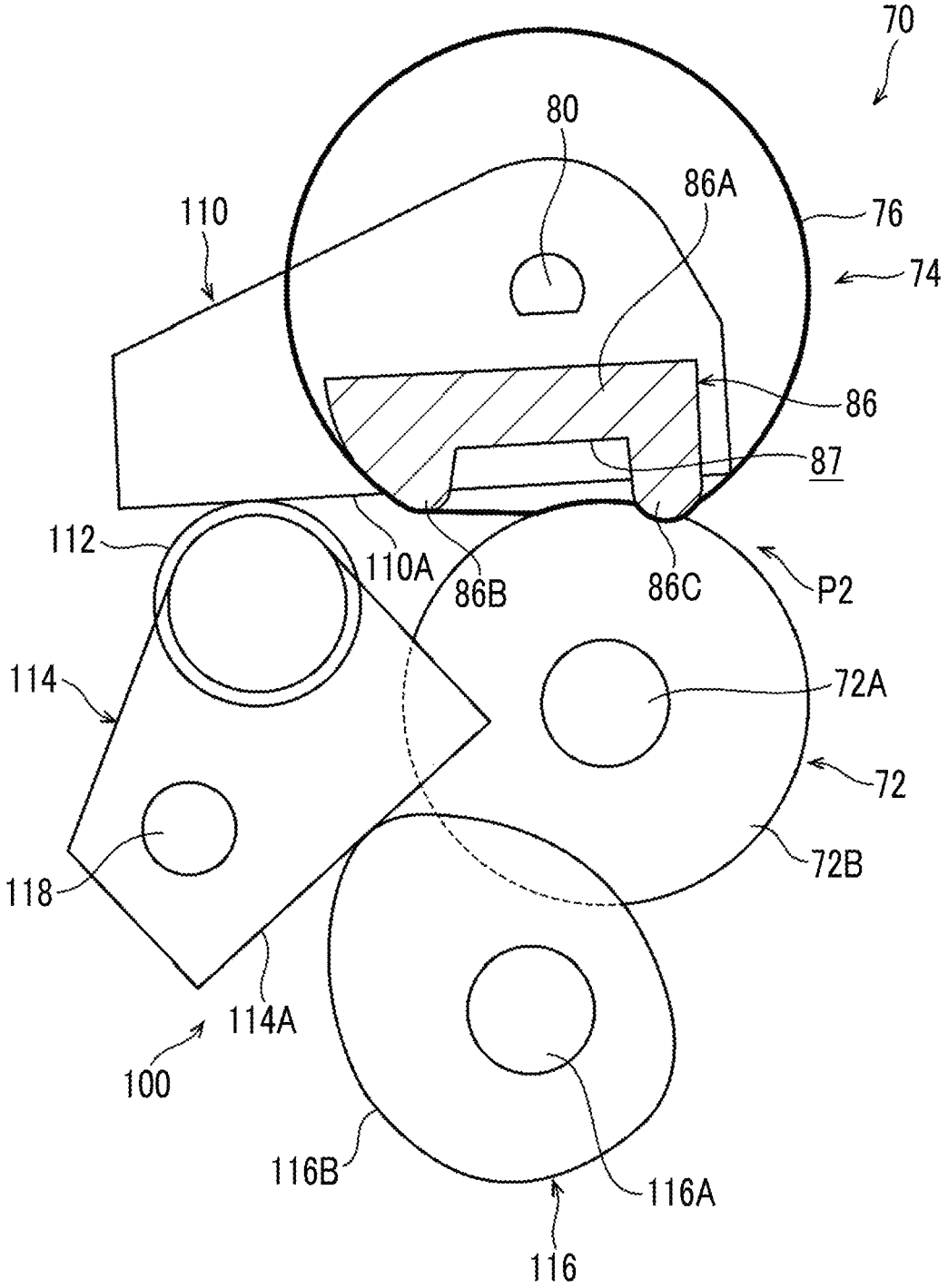
FIG. 6 is a configuration diagram illustrating a state of the cam in the second mode of the transport device according to the first exemplary embodiment.

FIGS. 5 and 6 illustrate a state where the positional relationship between the second transport member 74 and the first transport member 72 is changed to the second position P2 by the rotation of the cam 116 of the changing device 100 (in the exemplary embodiment, this state is referred to as the second mode). In the second mode, a region where the radius of the outer peripheral surface 116B of the cam 116 is the largest is in contact with the second lever 114 (refer to FIG. 6). As illustrated in FIG. 5, in a case where the second transport member 74 and the first transport member 72 are at the second position P2, the curved first sandwiching region 102 and the second sandwiching region 104 curved in the direction opposite to the first sandwiching region 102 are formed between the belt 76 of the second transport member 74 and the first transport member 72.

The first sandwiching region 102 is formed in a region where the belt 76 stretched over the pair of support portions 86B and 86C comes into contact with the elastic layer 72B of the first transport member 72. In the first sandwiching region 102, the inside of the belt 76 between the pair of support portions 86B and 86C is a space, and the belt 76 is in contact with the elastic layer 72B of the first transport member 72 by tension. The first sandwiching region 102 corrects the curling of the recording medium P in the direction opposite to the curved surface of the first transport member 72.

The second sandwiching region 104 is formed in a region where the belt 76 comes into contact with the elastic layer 72B of the first transport member 72 as the support portion 86C on the downstream side in the transport direction of the recording medium P pushes the belt 76 against the first transport member 72. In the second sandwiching region 104, the elastic layer 72B of the first transport member 72 that comes into contact with the belt 76 is recessed due to elastic deformation by the pushing force of the support portion 86C. Here, the support portion 86C is an example of a second curve forming portion that forms the second sandwiching region 104.

The second sandwiching region 104 has an arc (that is, a curved surface) in the same direction as the curved surface of the elastic layer 72B of the first transport member 72, and corrects the curling of the recording medium P in the direction opposite to the curved surface of the first transport member 72. For example, in the second sandwiching region 104, the curling in the same direction as the curved surface of the first transport member 72 in a case where the recording medium P is thin paper is corrected.

Although not illustrated, the changing device 100 is configured to change the positional relationship between the second transport member 74 and the first transport member 72 to a plurality of modes (for example, five-step modes) according to the rotational position of the cam 116. The width of the first sandwiching region 102 in the transport direction of the recording medium P and the width of the second sandwiching region 104 in the transport direction of the recording medium P are changed depending on a plurality of modes.

The changing device 100 changes the first position P1 illustrated in FIG. 3 to the second position P2 illustrated in FIG. 5, thereby changing the positional relationship between the first transport member 72 and the second transport member 74 so as to increase the width of the second sandwiching region 104 in the transport direction of the recording medium P without increasing the width of the first sandwiching region 102 in the transport direction of the recording medium P (refer to FIGS. 3 and 5). In the exemplary embodiment, by changing the first position P1 illustrated in FIG. 3 to the second position P2 illustrated in FIG. 5, the width of the first sandwiching region 102 in the transport direction of the recording medium P is reduced, and the width of the second sandwiching region 104 in the transport direction of the recording medium P is increased.

In the changing device 100, the support member 78 is configured not to rotate with the orbital movement of the belt 76. That is, the pad 86 constituting a part of the support member 78 does not rotate with the orbital movement of the belt 76.

Operation and Effect

Next, the operation and effect of the exemplary embodiment will be described.

As illustrated in FIG. 1, as the recording medium P on which a toner image has been transferred from the intermediate transfer belt 24 is transported to the fixing device 60 and passes through a nip portion between the heating member 64 and the pressing member 66, the toner image is fixed on the recording medium P by the heating and the pressing. The recording medium P on which the toner image is fixed is transported to the transport device 70.

In the transport device 70, as illustrated in FIGS. 4 and 6, the rotational position of the cam 116 is changed in advance according to the thickness of the recording medium P and the direction in which the recording medium P curls easily. Due to the rotation of the cam 116, the second lever 114 rocks in the upward-downward direction about the rotation shaft 118. With the rocking of the second lever 114 in the upward-downward direction, the first lever 110 that comes into contact with the rotating body 112 rocks in the upward-downward direction around the shaft portion 80 and the pad 86 fixed to the shaft portion 80 via the block 82 rotates about the shaft portion 80. Accordingly, the positional relationship between the first transport member 72 and the second transport member 74 is changed.

As illustrated in FIGS. 3 and 4, in the first mode, the second transport member 74 and the first transport member 72 are at the first position P1, and the curved first sandwiching region 102 is formed between the belt 76 of the second transport member 74 and the first transport member 72. That is, in the second transport member 74, the belt 76 is in contact with the first transport member 72 between the pair of support portions 86B and 86C of the pad 86, and the first sandwiching region 102 is formed between the belt 76 and the first transport member 72. The first sandwiching region 102 has the arc (that is, a curved surface) in the same direction as a curved surface of the elastic layer 72B of the first transport member 72, and corrects the curling of the recording medium P in the direction opposite to the curved surface of the first transport member 72.

As illustrated in FIGS. 5 and 6, in the second mode, the second transport member 74 and the first transport member 72 are at the second position P2, and the curved first sandwiching region 102 and the second sandwiching region 104 curved in the direction opposite to the first sandwiching region 102 are formed between the belt 76 of the second transport member 74 and the first transport member 72. By changing from the first position P1 to the second position P2, the width of the first sandwiching region 102 in the transport direction of the recording medium P is reduced, and the width of the second sandwiching region 104 in the transport direction of the recording medium P is increased.

The second sandwiching region 104 has the arc (that is, the curved surface) in the direction opposite as the curved surface of the elastic layer 72B of the first transport member 72, and corrects the curling of the recording medium P in the same direction as the curved surface of the first transport member 72.

Here, a transport device 200 of a comparative example will be described with reference to FIGS. 9 and 10.

Figure 9:
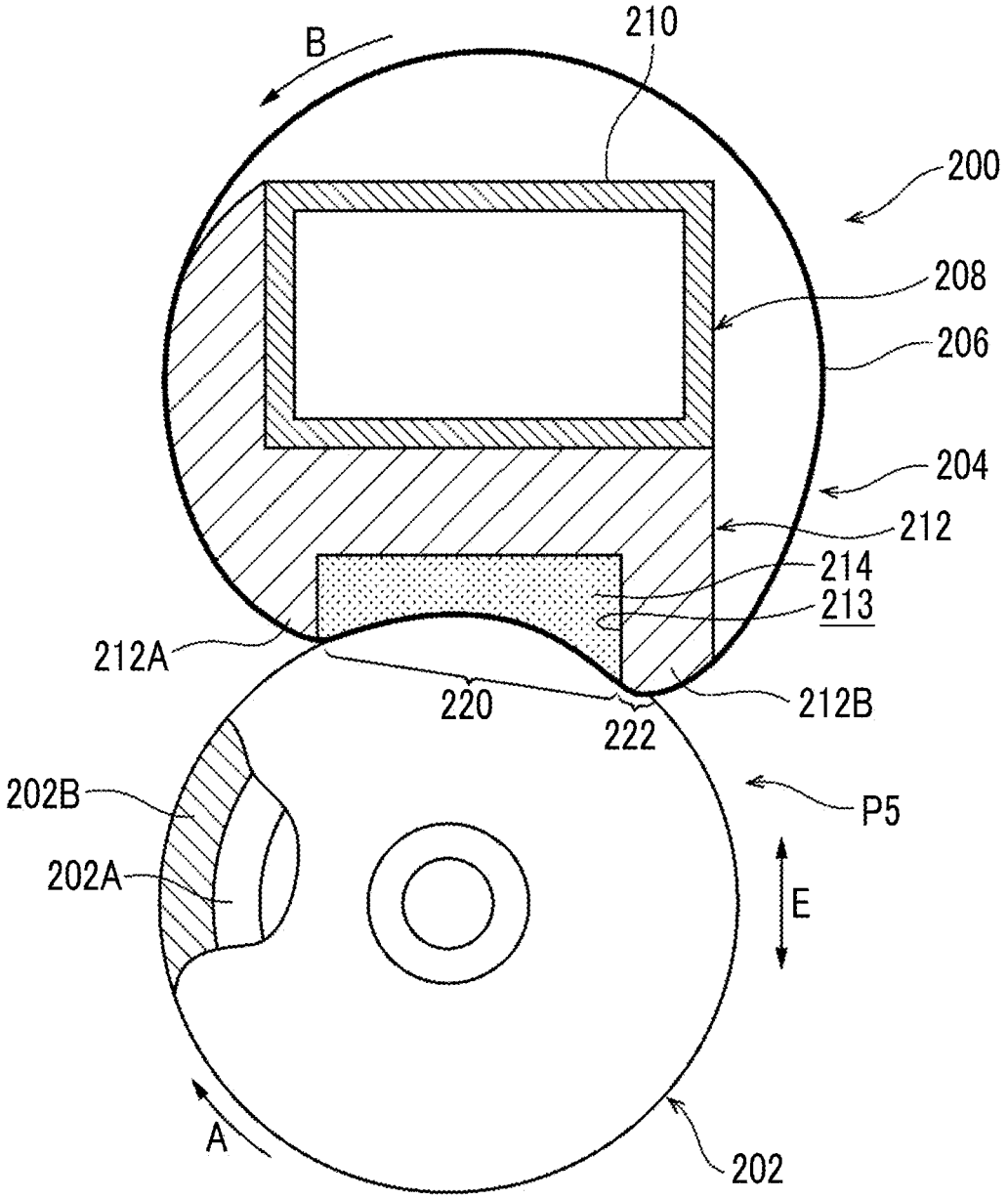
FIG. 9 is a cross-sectional view illustrating a state where the position of a pad in a transport device of a comparative example is changed to the first mode.
Figure 10:
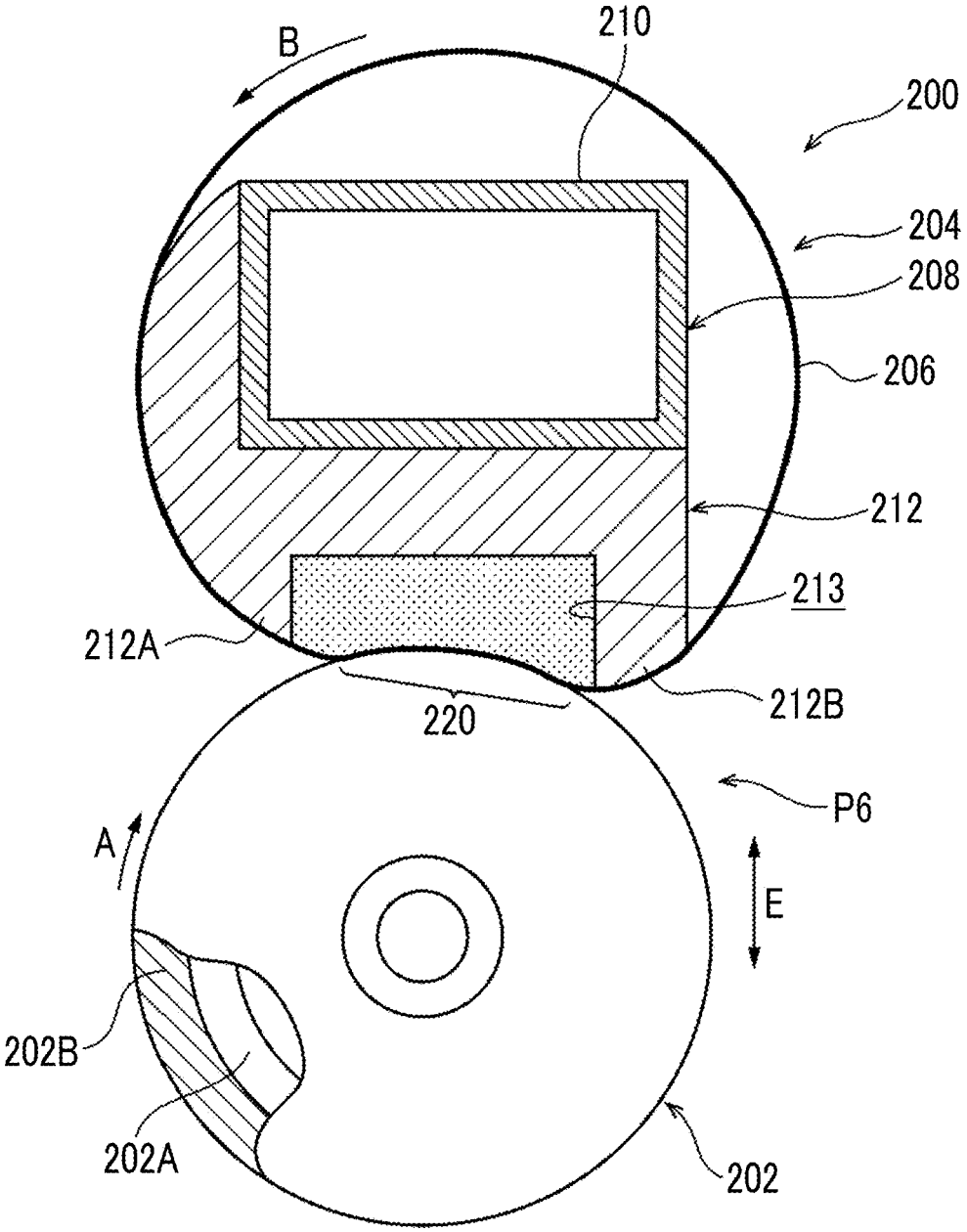
FIG. 10 is a cross-sectional view illustrating a state where the position of the pad in the transport device of the comparative example is changed to the second mode.

As illustrated in FIGS. 9 and 10, the transport device 200 of the comparative example includes a first transport member 202 that rotates in the direction of arrow A, and a second transport member 204 that sandwiches and transports the recording medium P between the second transport member 204 and the first transport member 202.

The first transport member 202 is configured by a roll-shaped member. The first transport member 202 includes a cylindrical core bar 202A and an elastic layer 202B that covers the periphery of the core bar 202A.

The second transport member 204 includes an endless belt member 206 and a support member 208 that is disposed inside the belt member 206 and pushes the belt member 206 against the first transport member 202. The support member 208 supports the belt member 206 so as to be movable orbitally.

The support member 208 includes a block 210, a pressing member 212 attached to the block 210, and a pad 214 supported by the pressing member 212. The pressing member 212 is formed of a member that is harder than the pad 214. The pad 214 is made of an elastically deformable member such as rubber. The pressing member 212 includes a pair of protruding portions 212A and 212B protruding toward the first transport member 202, and a recessed portion 213 formed between the pair of protruding portions 212A and 212B. The pad 214 is attached to the pressing member 212 by bonding or the like in a state where the pad 214 is inserted into the recessed portion 213 of the pressing member 212.

The first transport member 202 is movable by a position changing mechanism (not illustrated) in a direction intersecting the axial direction of the second transport member 204 as indicated by an arrow E or in a direction approaching or retreating with respect to the second transport member 204. By the position changing mechanism, the first transport member 202 is configured to be switched between the first position P5 (first mode) illustrated in FIG. 9 and the second position P6 (second mode) illustrated in FIG. 10.

As illustrated in FIG. 9, at the first position P5, the first transport member 202 moves toward the second transport member 204 more than the second position P6, and the first transport member 202 deeply bites into the pad 214. Accordingly, the first sandwiching region 220 where the belt member 206 and the first transport member 202 come into contact with each other and are curved along the elastic layer 202B of the first transport member 202 is formed on the upstream side in the transport direction of the recording medium P. Moreover, the second sandwiching region 222 where the belt member 206 and the first transport member 202 come into contact with each other and are curved to the side opposite to the first sandwiching region 220 is formed on the downstream side in the transport direction of the recording medium P.

As illustrated in FIG. 10, at the second position P6, the first transport member 202 moves to the side retreating from the second transport member 204 more than the first position P5, and the biting of the pad 214 by the first transport member 202 decreases. Accordingly, the first sandwiching region 220 where the belt member 206 and the first transport member 202 come into contact with each other and are curved along the elastic layer 202B of the first transport member 202 is formed.

In the transport device 200 of the comparative example, in a case where the first transport member 202 is switched from the second position P6 to the first position P5, the width of the first sandwiching region 220 in the transport direction of the recording medium P at the first position P5 is larger than the width of the first sandwiching region 220 at the second position P6 in the transport direction of the recording medium P. In this case, the curvature of the curved surface of the first sandwiching region 220 at the first position P5 is larger than the curvature of the curved surface of the first sandwiching region 220 at the second position P6. Accordingly, since the first sandwiching region 220 causes the curling of the recording medium P once in the direction opposite to the direction in which the curling of the recording medium P is to be corrected in the second sandwiching region 222, there is a case that the curling of the recording medium P cannot be sufficiently corrected.

In contrast, in the transport device 70 of the exemplary embodiment, as the first position P1 is changed to the second position P2, the width of the first sandwiching region 102 in the transport direction of the recording medium P is reduced, and the width of the second sandwiching region 104 in the transport direction of the recording medium P is increased. In other words, in a case where the first position P1 is changed to the second position P2, the width of the curved surface of the first sandwiching region 102 in the transport direction of the recording medium P is reduced, and the second sandwiching region 104 is newly formed. For this reason, in the transport device 70, poor curling correction of the recording medium P is suppressed as compared to a case where both the first sandwiching region and the second sandwiching region curved in opposite directions increase.

Additionally, in the transport device 70, poor curling correction of the recording medium P is suppressed as compared to a configuration in which the width of one of the first sandwiching region and the second sandwiching region in the medium transport direction is constant.

Additionally, the transport device 70 includes, inside the belt 76, the recessed portion 87 between the pair of support portions 86B and 86C forming the first sandwiching region 102 and the support portion 86C forming the second sandwiching region 104. For this reason, in the transport device 70, a mechanism for transporting the recording medium P is simplified as compared to a configuration in which the first curve forming portion and the second curve forming portion are provided without the belt.

Additionally, in the transport device 70, the pad 86 including the recessed portion 87 and the support portion 86C is configured not to rotate with the orbital movement of the belt 76. For this reason, in the transport device 70, the structure is simplified as compared to a configuration in which the first curve forming portion and the second curve forming portion rotate with the orbital movement of the belt.

Additionally, in the transport device 70, the first sandwiching region 102 is formed between the pair of support portions 86B and 86C by the belt 76 being stretched over the pair of support portions 86B and 86C arranged at a distance. For this reason, in the transport device 70, compared to a case where one of the first curve forming portion and the second curve forming portion is formed by the pushing member, the movement, that is, the positional deviation of the belt 76 in the direction intersecting the orbiting direction is suppressed.

Additionally, the transport device 70 includes the support member 78 that rotates about the shaft portion 80 that extends in a direction along the center of the orbital movement of the belt 76, and the widths of the first sandwiching region 102 and the second sandwiching region 104 in the transport direction of the recording medium P are changed by rotating the support member 78. For this reason, the structure of the transport device 70 is simplified as compared to a configuration in which the first curve forming portion and the second curve forming portion are separately moved.

Additionally, in the transport device 70, in a case where the widths of the first sandwiching region 102 and the second sandwiching region 104 in the transport direction of the recording medium P are changed, only the support member 78 is rotated. For this reason, the structure of the transport device 70 is simplified as compared to a configuration in which the belt is moved together with the rotating member.

Additionally, in the transport device 70, the shaft portion 80 for rotating the support member 78 is inside the belt 76. For this reason, in the transport device 70, the support structure of the belt 76 is simplified as compared to a configuration in which a shaft for rotating the rotating member is outside the belt.

Additionally, in the image forming apparatus 10, the changing device 100 changes the positional relationship between the first transport member 72 and the second transport member 74, thereby changing the width of the recording medium P in the transport direction in the first sandwiching region 102 and the second sandwiching region 104. For this reason, in the image forming apparatus 10, even in a case where the direction of curling of the recording medium after fixing is different, poor curling correction of the recording medium P is suppressed.

Second Exemplary Embodiment

Next, a transport device according to a second exemplary embodiment will be described. In addition, the identical components as the components in the aforementioned first exemplary embodiment will be denoted by the identical reference numerals and the description thereof will be omitted.

Figure 7:
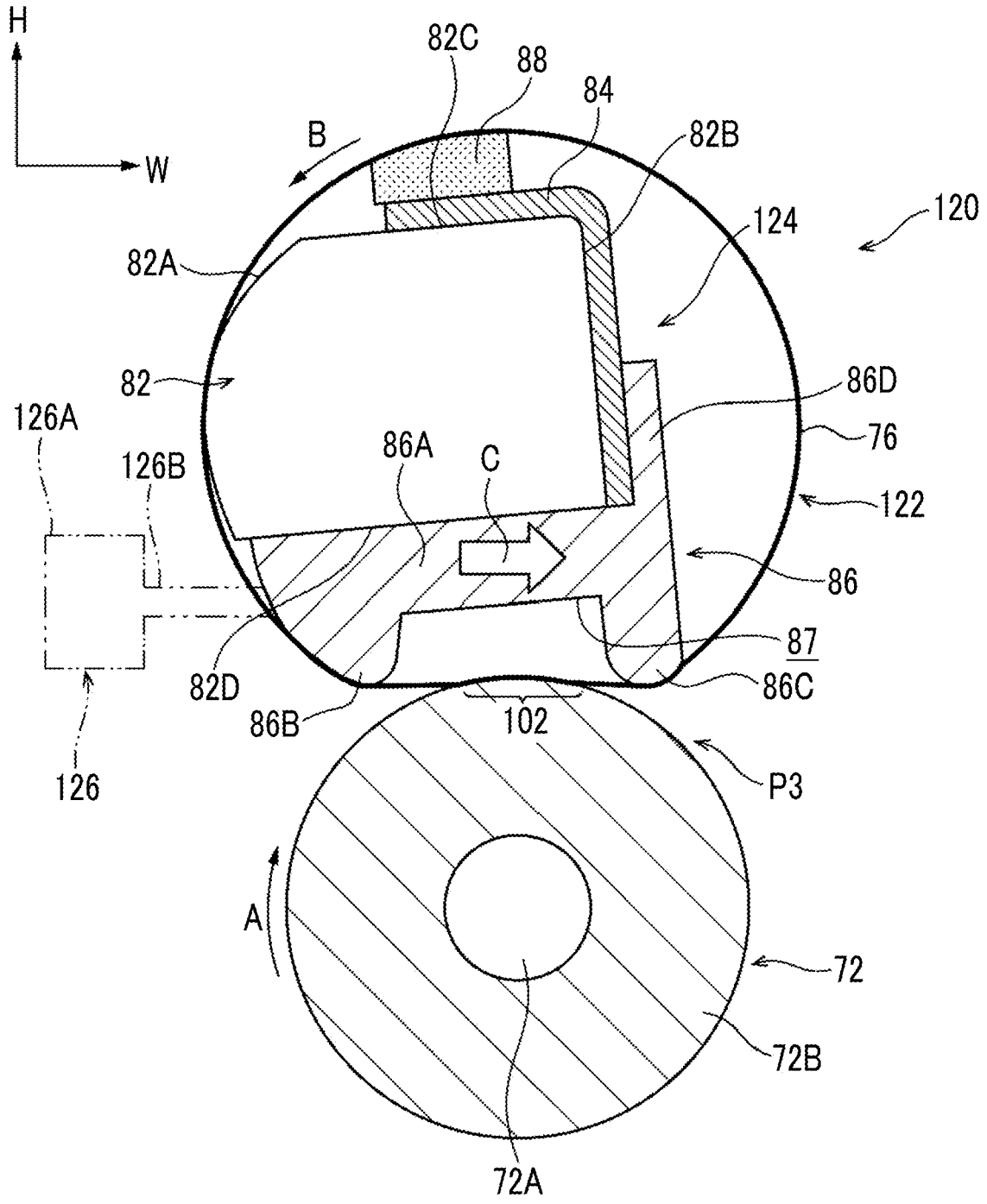
FIG. 7 is a cross-sectional view illustrating a state where the position of a pad in a transport device according to the second exemplary embodiment is changed to the first mode.
Figure 8:
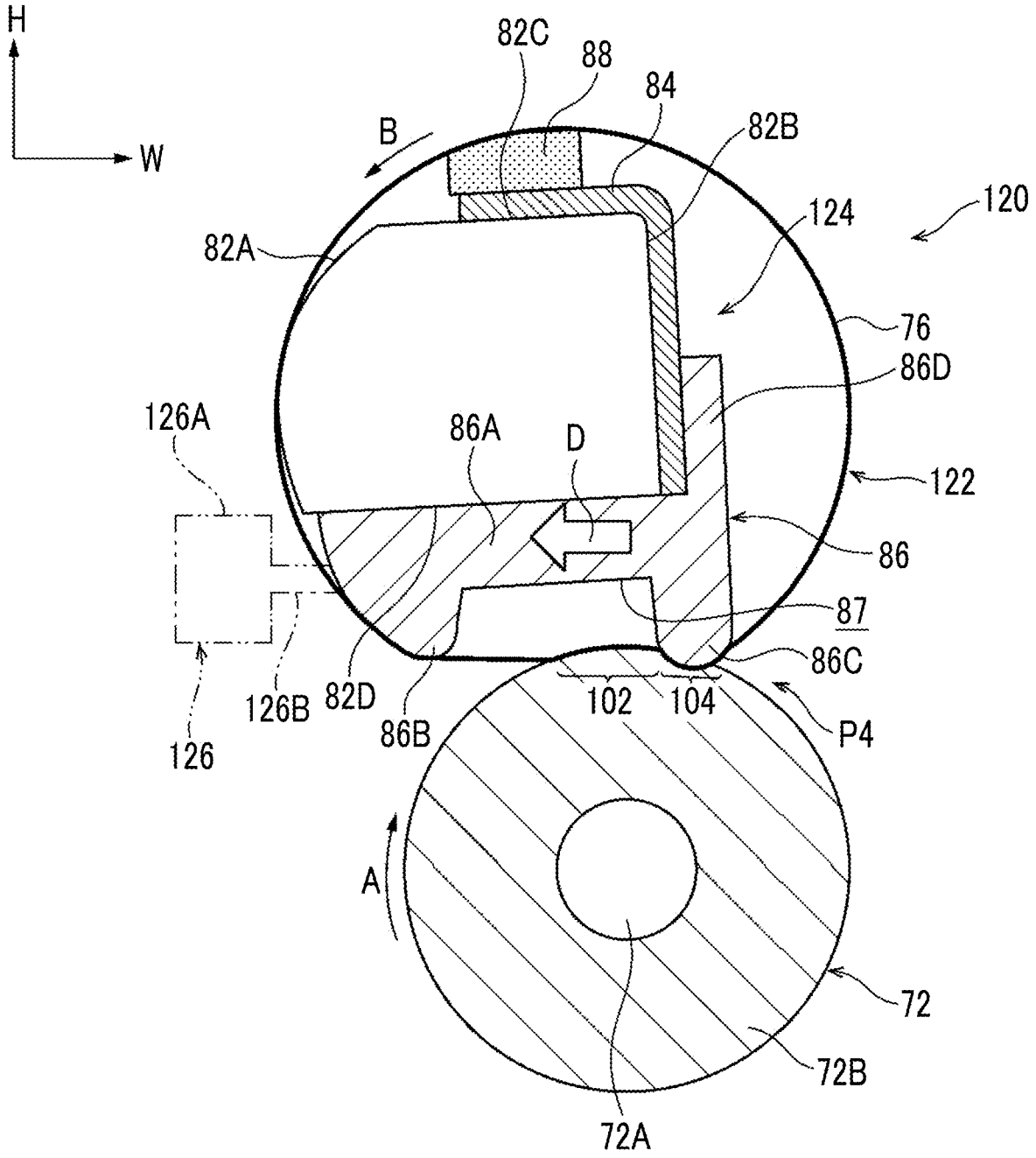
FIG. 8 is a cross-sectional view illustrating a state where the position of the pad in the transport device according to the second exemplary embodiment is changed to the second mode.

As illustrated in FIGS. 7 and 8, a transport device 120 according to the second exemplary embodiment includes the first transport member 72 rotating in the direction of arrow A and a second transport member 122 that sandwiches and transports the recording medium P between the second transport member 122 and the first transport member 72.

The second transport member 122 includes the endless belt 76 and a moving member 124 that is movably disposed inside the belt 76 and that supports the belt 76 so as to be movable orbitally in the direction of arrow B.

The moving member 124 includes the block 82, the holding plate 84 attached to the block 82, the pad 86 attached to the block 82 and the holding plate 84 on the first transport member 72 side, and the felt 88 attached to the holding plate 84.

Moreover, the transport device 120 includes a changing device 126 that moves the moving member 124 in the direction intersecting the axial direction of the first transport member 72 and in the orbital movement direction of the belt 76, thereby changing a positional relationship between the first transport member 72 and the second transport member 122. Here, the changing device 126 is an example of a changing unit.

The changing device 126 is configured by a hydraulic cylinder or the like, and includes a body portion 126A and a rod 126B that is movable forward and backward from the body portion 126A. A distal end of the rod 126B is fixed to the pad 86 or the block 82 of the moving member 124. In the changing device 126, the moving member 124 moves in the directions of arrows C and D, which are directions along the transport direction of the recording medium P, by the rod 126B moving forward and backward with respect to the body portion 126A. The movement of the moving member 124 changes the widths, in the transport direction of the recording medium P, of the first sandwiching region 102 and the second sandwiching region 104 where the belt 76 and the first transport member 72 come into contact with each other.

The changing device 126 changes the widths of the first sandwiching region 102 and the second sandwiching region 104 in the transport direction of the recording medium P by moving only the moving member 124.

FIG. 7 illustrates a state where a positional relationship between the second transport member 122 and the first transport member 72 is the first position P3 due to the movement of the moving member 124 in the direction of arrow C by the changing device 126 (in the exemplary embodiment, this state is referred to as the first mode). At the first position P3, the curved first sandwiching region 102 is formed between the belt 76 of the second transport member 74 and the first transport member 72. The first sandwiching region 102 is formed in a region where the belt 76 stretched over the pair of support portions 86B and 86C comes into contact with the elastic layer 72B of the first transport member 72. That is, the first sandwiching region 102 is formed between the pair of support portions 86B and 86C by the belt 76 being stretched over the pair of support portions 86B and 86C.

FIG. 8 illustrates a state where a positional relationship between the second transport member 122 and the first transport member 72 is changed to the second position P4 due to the movement of the moving member 124 in the direction of arrow D by the changing device 126 (in the exemplary embodiment, this state is referred to as the second mode). In the second mode, the curved first sandwiching region 102 and a second sandwiching region 104 curved in the direction opposite to the first sandwiching region 102 are formed between the belt 76 of the second transport member 74 and the first transport member 72.

The first sandwiching region 102 is formed in a region where the belt 76 stretched over the pair of support portions 86B and 86C comes into contact with the elastic layer 72B of the first transport member 72.

The second sandwiching region 104 is formed in a region where the belt 76 comes into contact with the elastic layer 72B of the first transport member 72 as the support portion 86C on the downstream side in the transport direction of the recording medium P pushes the belt 76 against the first transport member 72. In the second sandwiching region 104, the elastic layer 72B of the first transport member 72 that comes into contact with the belt 76 is recessed due to elastic deformation by the pushing force of the support portion 86C.

In the transport device 120 described above, by changing from the first position P3 to the second position P4, the width of the first sandwiching region 102 in the transport direction of the recording medium P is reduced, and the width of the second sandwiching region 104 in the transport direction of the recording medium P is increased. In other words, in a case where the first position P3 is changed to the second position P4, the size of the curved surface of the first sandwiching region 102 is reduced, and the second sandwiching region 104 is newly formed. For this reason, in the transport device 120, poor curling correction of the recording medium P is suppressed as compared to a case where both the first sandwiching region and the second sandwiching region curved in opposite directions increase.

Moreover, the transport device 120 has effects shown below in addition to the effects of the same configuration as the transport device 70 of the first exemplary embodiment.

The transport device 120 includes the pad 86 and includes the moving member 124 that moves in the orbital movement direction of the belt 76, and the changing device 126 changes the widths of the first sandwiching region 102 and the second sandwiching region 104 in the transport direction of the recording medium P by moving the moving member 124. For this reason, the structure of the transport device 120 is simplified as compared to a configuration in which the first curve forming portion and the second curve forming portion are separately moved.

In the transport device 120, in a case where the widths of the first sandwiching region 102 and the second sandwiching region 104 in the transport direction of the recording medium P are changed, only the moving member 124 is moved. For this reason, the structure of the transport device 120 is simplified as compared to a configuration in which the belt is moved together with the moving member.

In the transport device 120, the moving member 124 moves in the transport direction of the recording medium P. For this reason, in the transport device 120, the recording medium P is smoothly transported between the first transport member 72 and the second transport member 122 as compared to a configuration in which the moving member is moved in a direction different from the transport direction of the medium.

Supplementary Description

In addition, in the first and second exemplary embodiments, the changing devices 100 and 126 are provided. However, the configurations of the changing devices 100 and 126 can be changed. For example, a configuration may be adopted in which the widths of the first sandwiching region and the second sandwiching region in the transport direction of the recording medium may be changed by a changing unit such as a solenoid, a rack and pinion, and a cylinder.

Additionally, in the above first and second exemplary embodiments, the pad 86 is provided inside the belt 76, and the rotation or movement of the pad 86 changes the widths of the first sandwiching region 102 and the second sandwiching region 104 in the transport direction of the recording medium P. However, the present invention is not limited to this. For example, a configuration may be adopted in which the widths of the first sandwiching region and the second sandwiching region in the transport direction of the recording medium P are changed by providing the first curve forming portion forming the first sandwiching region and the second curve forming portion forming the second sandwiching region may be provided inside the endless belt and moving the first curve forming portion and the second curve forming portion.

The changing devices 100 or 126 changes the positional relationship between the first transport member 72 and the second transport members 74 or 122 so as to increase the width of the second sandwiching region 104 in the transport direction of the recording medium P without increasing the width of the first sandwiching region 102 in the transport direction of the recording medium P. However, the present invention is not limited to this. For example, the changing device may be configured to change the positional relationship between the first transport member and the second transport member so as to increase the width of the first sandwiching region in the transport direction of the recording medium P without increasing the width of the second sandwiching region in the transport direction of the recording medium P. Additionally, for example, the changing device may be configured to change the positional relationship between the first transport member and the second transport member so as to reduce the width of the second sandwiching region in the transport direction of the recording medium P and increase the width of the first sandwiching region in the transport direction of the recording medium P.

Additionally, in the above first and second exemplary embodiments, a configuration may be adopted in which the widths of the first sandwiching region and the second sandwiching region in the transport direction of the recording medium are changed by the changing device by detecting the state of curling of the recording medium P by a sensor after the recording medium P has passed through the fixing device 60.

Additionally, instead of the image forming apparatus 10 of the above-described exemplary embodiments, a configuration may be adopted in which a transport device independent of the image forming apparatus is provided as an optional post-processing device to correct the curling of the recording medium P.

Additionally, in the above exemplary embodiments, the image forming apparatus 10 has been described by taking an electrophotographic apparatus as an example. However, the exemplary invention may be applied to image forming apparatuses of other types such as an ink jet type, a relief printing type, a planographic printing type, and an intaglio printing type. For example, in a case where the recording medium is curled by a drying device provided at a subsequent stage of the image forming apparatuses, the curling may be corrected by applying the transport device 70 of the above exemplary embodiments.

Additionally, the present invention may be applied to a thermal transfer type image forming apparatus using a roller. For example, in a case where a sheet-like medium as a transfer target is curled after an image is thermally transferred, the curling may be corrected by applying the transport device 70 of the above exemplary embodiments.

Moreover, the present invention may be applied to apparatuses other than the image forming apparatuses. For example, in a thermocompression bonding device that thermocompression-bonds a sheet-like medium to be compressed and a film by heating and pressing by a roller, the transport device 70 of the above exemplary embodiments may be applied in a case where the sheet-like medium after the thermocompression bonding is curled.

In addition, the above-described drying device, thermal transfer device, and thermocompression bonding device are examples of the heating device in the present invention.

Additionally, media other than a curled sheet-like medium may be corrected by heating. For example, the present invention may be applied to the correction of a curled sheet-like medium depending on storage environments (temperature and humidity) of the sheet medium.

In addition, although the present invention has been described in detail with respect to specific exemplary embodiments, the present invention is not limited to such exemplary embodiments, and it will be apparent to one of ordinary skill in the art that various other exemplary embodiments are possible within the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a first transport member that orbits in a predetermined direction and transports a sheet-like medium, wherein the first transport member is roll-shaped and comprises a rotation shaft;

a second transport member that forms a first sandwiching region that is curved and a second sandwiching region that is curved in a direction opposite to the first sandwiching region between the first transport member and the second transport member, and sandwiches and transports the medium in the first sandwiching region and the second sandwiching region, wherein the second transport member comprises a supporting assembly and a belt winding around the supporting assembly; and a position changing assembly, comprising at least a cam or at least a reciprocally movable rod, wherein the position changing assembly changes a positional relationship between the first transport member and the second transport member so as to increase a width of the other of the first sandwiching region and the second sandwiching region in a transport direction of the medium without increasing a width of one of the first sandwiching region and the second sandwiching region in the transport direction of the medium, wherein the belt moves orbitally in the transport direction of the medium and the supporting assembly is configured not to rotate with the orbital movement of the belt.

2. The transport device according to claim 1, wherein the position changing assembly changes the positional relationship between the first transport member and the second transport member so as to increase the width of the other of the first sandwiching region and the second sandwiching region in the transport direction of the medium and decrease the width of one of the first sandwiching region and the second sandwiching region.

3. The transport device according to claim 2, wherein the supporting assembly is configured such that the first sandwiching region or the second sandwiching region is formed between a pair of support portions by the belt being stretched over the pair of support portions arranged at a distance.

4. The transport device according to claim 3, wherein the supporting assembly comprises a rotatable block that rotates about a shaft extending in a direction along a center of the orbital movement of the belt, wherein the position changing assembly changes the widths of the first sandwiching region and the second sandwiching region in the transport direction of the medium by rotating the rotatable block.

5. The transport device according to claim 2, wherein the supporting assembly comprises a rotatable block that rotates about a shaft extending in a direction along a center of the orbital movement of the belt, wherein the position changing assembly changes the widths of the first sandwiching region and the second sandwiching region in the transport direction of the medium by rotating the rotatable block.

6. The transport device according to claim 5, wherein only the rotatable block is rotated in a case where the widths of the first sandwiching region and the second sandwiching region in the transport direction of the medium are changed.

7. The transport device according to claim 1, wherein the supporting assembly is configured such that the first sandwiching region or the second sandwiching region is formed between a pair of support portions by the belt being stretched over the pair of support portions arranged at a distance.

8. The transport device according to claim 7, wherein the supporting assembly comprises a rotatable block that rotates about a shaft extending in a direction along a center of the orbital movement of the belt, wherein the position changing assembly changes the widths of the first sandwiching region and the second sandwiching region in the transport direction of the medium by rotating the rotatable block.

9. The transport device according to claim 1, wherein the supporting assembly comprises a rotatable block that rotates about a shaft extending in a direction along a center of the orbital movement of the belt, wherein the position changing assembly changes the widths of the first sandwiching region and the second sandwiching region in the transport direction of the medium by rotating the rotatable block.

10. The transport device according to claim 9, wherein only the rotatable block is rotated in a case where the widths of the first sandwiching region and the second sandwiching region in the transport direction of the medium are changed.

11. The transport device according to claim 10, wherein the shaft for rotating the rotatable block is inside the belt.

12. The transport device according to claim 1, wherein the supporting assembly comprises a movable lever that moves in an orbital movement direction of the belt, wherein the position changing assembly changes the widths of the first sandwiching region and the second sandwiching region in the transport direction of the medium by moving the movable lever.

13. The transport device according to claim 12, wherein only the movable lever is moved in a case where the widths of the first sandwiching region and the second sandwiching region in the transport direction of the medium are changed.

14. The transport device according to claim 12, wherein the movable lever is moved in the transport direction of the medium.

15. An image forming apparatus comprising:

a heating device that heats the medium; and the transport device according to claim 1 that is disposed on a downstream side of the heating device in the transport direction of the medium.

16. The image forming apparatus according to claim 15, wherein the heating device includes a heating member that is disposed on a side of the second transport member with respect to the medium and rotates; and a pressing member that is disposed on a side of the first transport member with respect to the medium and includes a winding belt that moves orbitally by a rotation of the heating member, and a pushing portion that pushes the winding belt against the heating member.

* * * * *